United States Patent [19]

Herridge

[11] 4,274,678

[45] Jun. 23, 1981

[54] SOCKETED BOSS HAVING MEANS FOR RETAINING A TOOL SHANK

[75] Inventor: Frederick Herridge, Buckinghamshire, England

[73] Assignee: Austin Hoy and Company Limited, High Wycombe, England

[21] Appl. No.: 56,726

[22] Filed: Jul. 11, 1979

[51] Int. Cl.[3] ..... E21C 35/18

[52] U.S. Cl. ..... 299/92; 37/142 A

[58] Field of Search ..... 85/8.3; 299/92; 37/142 A; 403/277, 357

[56] References Cited

U.S. PATENT DOCUMENTS

| | | | |
|---|---|---|---|
| 2,987,332 | 6/1961 | Bonmartini | 37/142 A |
| 3,277,592 | 10/1966 | Launder | 37/142 A |
| 3,773,114 | 11/1973 | Griffin | 37/142 A |
| 3,796,464 | 3/1974 | Hansen et al. | 299/92 |
| 4,087,928 | 5/1978 | Mickus | 299/92 |

*Primary Examiner*—William F. Pate, III

*Attorney, Agent, or Firm*—Brady, O'Boyle & Gates

[57] ABSTRACT

A mineral mining pick boss having a socket therein for the reception of a shank of a mineral mining pick and a locking arrangement for retaining the shank, the locking arrangement comprising a plug received in a bore extending through the boss transversely of the socket the arrangement being such that the bore intersects the socket, the plug comprising a body of a resilient material (e.g. neoprene) having bonded into the periphery thereof at spaced locations a plurality of metallic members one of which protrudes from the bore into the socket for frictional engagement with the shank of the tool so as to retain the tool in position, the other(s) of the metallic members being disposed within the bore, and the arrangement of the metallic members being such that the plug may be removed from the bore, rotated and re-inserted to change the metallic member which protrudes into the socket.

10 Claims, 7 Drawing Figures

SOCKETED BOSS HAVING MEANS FOR RETAINING A TOOL SHANK

This invention relates to means for holding a shank of a tool in a socket, and is particularly but not exclusively for use in retaining a mineral cutter pick in a socket in mining machinery.

It is known to retain a mineral cutter pick in a socket by means of a resilient plug which forces a metal pin against the shank of the pick, the shank being formed with a surface such that the pin exerts a frictional force which tends to keep the cutter pick pulled down on its seating. An arrangement of this type is shown for example in the complete specification of U.K. Pat. No. 895,764.

Prior constructions of this type require a rather large diameter of resilient plug which limits the applications of such locks. They also require relatively frequent replacement of the plugs, since the pins tend to wear fairly rapidly.

It is an object of the present invention to provide an improved lock for retaining a shank in a socket.

The present invention accordingly provides a boss having a socket therein for the reception of a shank of a tool and a locking arrangement for retaining the shank, the locking arrangement comprising a plug received in a bore extending through the boss transversely of the socket the arrangement being such that the bore intersects the socket, the plug comprising a body of a resilient material having bonded into the periphery thereof at spaced locations a plurality of metallic members one of which protrudes from the bore into the socket for frictional engagement with the shank of the tool so as to retain the tool in position, the other(s) of the metallic members being disposed within the bore, and the arrangement of the metallic members being such that the plug may be removed from the bore, rotated and reinserted to change the metallic member which protrudes into the socket.

The invention also encompasses a mineral mining machine provided with one or more bosses as defined above.

Embodiments of the present invention will now be described, by way of example, with reference to the accompanying drawings, in which.

Figure 5:
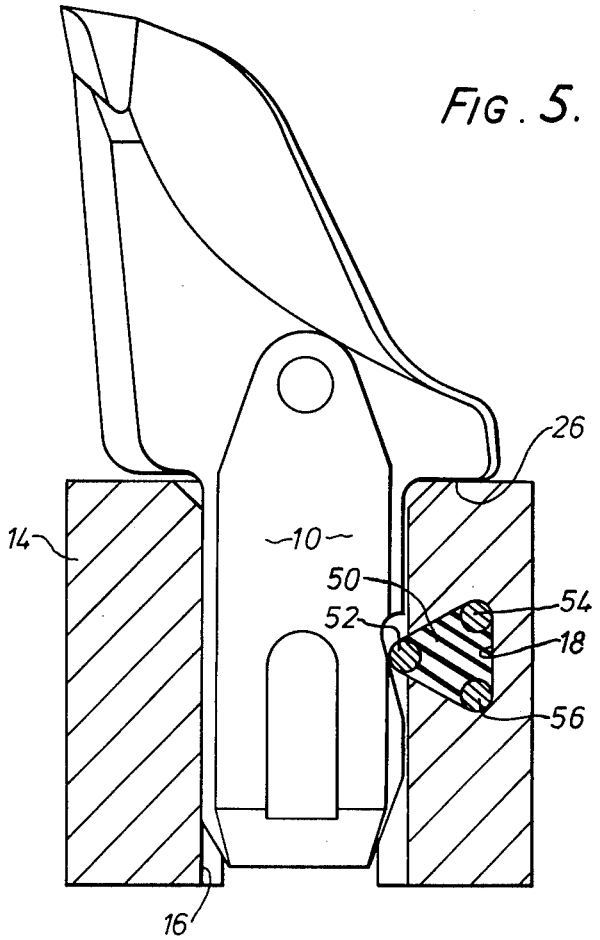
Figure 6:
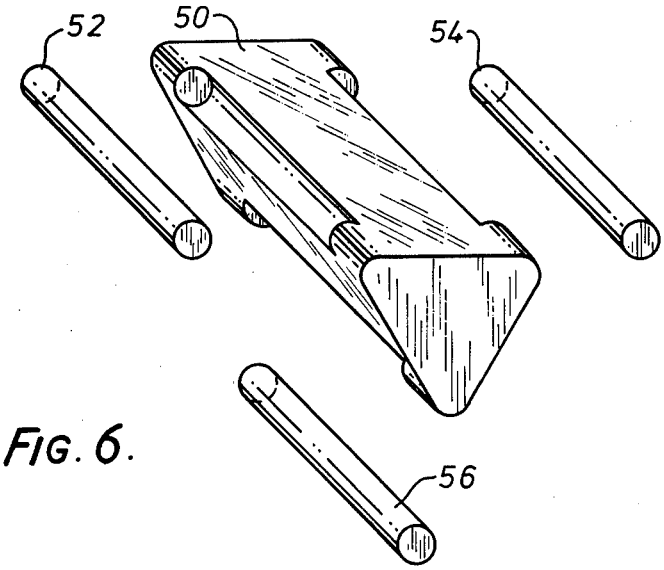
Figure 7:
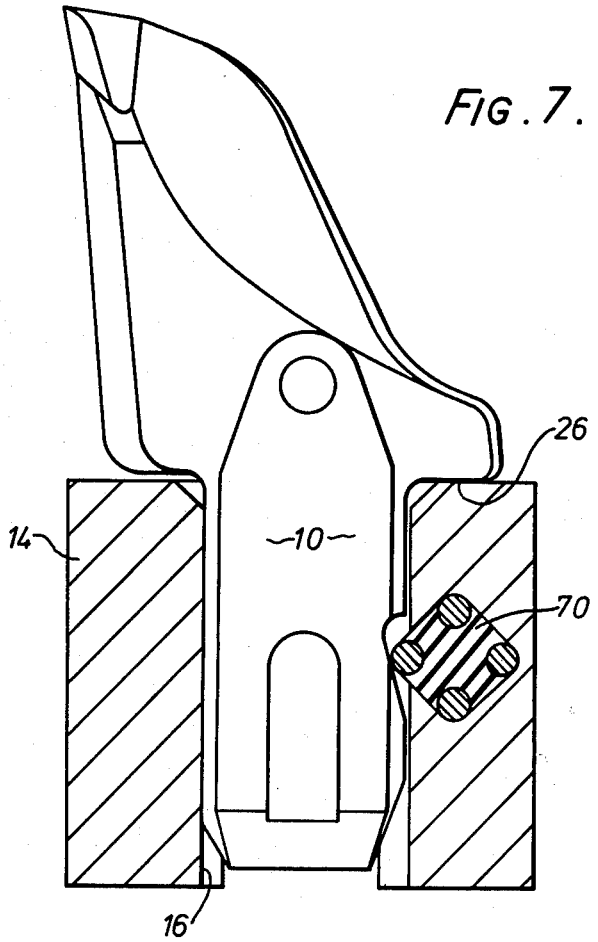

FIG. 5 similarly shows a third embodiment;

FIG. 6 is an exploded perspective view of the locking means of FIG. 5; and FIG. 7 is a part-sectional side elevation of a final embodiment.

Figure 1:
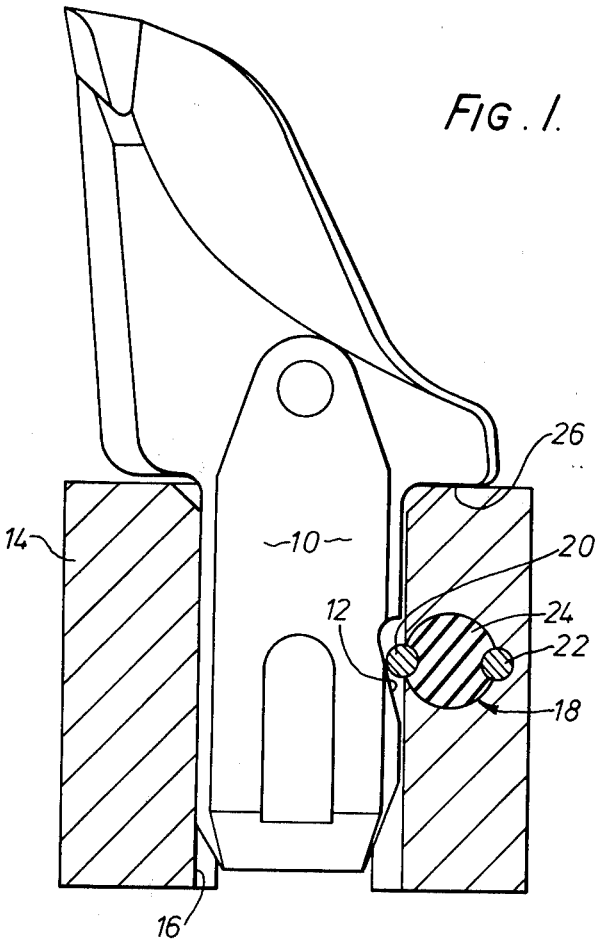
FIG. 1 is a side elevation of a mineral cutter pick received in a pick boss, the boss being sectioned through its central plane, and incorporating one embodiment of the invention.

Referring to FIG. 1, a mineral cutter pick of known type has a shank 10 in which is formed a groove having a sloping shoulder 12 transverse to the direction of motion, in use, of the cutter pick. The shank 10 of the cutter pick is received in a metal boss 14 which in use is secured as by welding to a cutter drum or chain of a minimg machine. The boss 14 has a socket 16 passing therethrough and dimensioned to receive the shank 10 of the pick.

A bore 18 is formed through the boss 14 in a direction at right angles to the socket 16. The bore 18 has the form of three superimposed cylinders.

Figure 2:
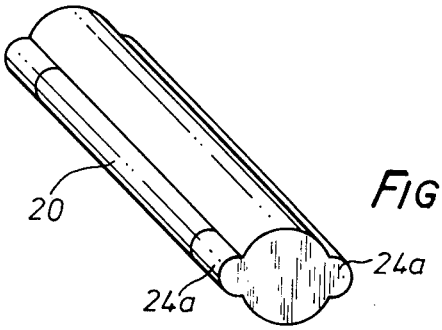
FIG. 2 is a perspective view of a locking means of FIG. 1.
Figure 3:
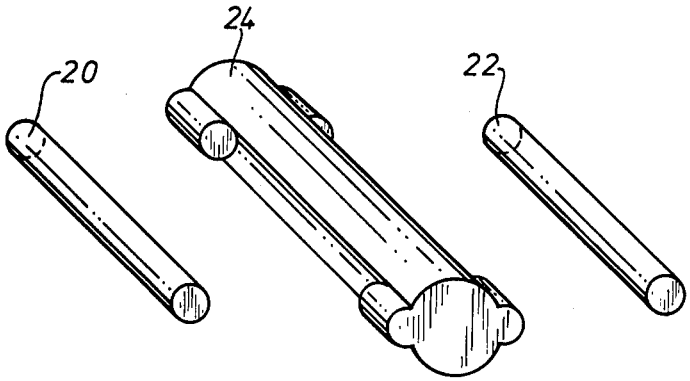
FIG. 3 is an exploded perspective view of the parts of FIG. 2.

The bore 18 receives a locking plug comprising metal rods 22 and 20 bonded into a body of neoprene 24, as seen in greater detail in FIGS. 2 and 3. The rods 20 and 22 are shorter in length than the neoprene body 24, the latter being extended at its ends as indicated at **24*a* to cover the ends of the rods 20, 22**.

In use, the shank 10 of the cutter pick may be inserted downwardly into the socket 16. During such insertion the rod 20 which projects into the socket is forced back against the neoprene body 24 and is then sprung against the shoulder 12. Because of the inclination of the shoulder 12, the neoprene body 24 exerts a resilient force causing the rod 20 to frictionally engage the shoulder and force the pick downwardly to bring a shoulder 26 on the pick into abutment with the top of the boss 14.

When the rod 20 becomes worn to an unacceptable extent, the entire plug 20, 22, 24 may be withdrawn and replaced turned through 180° to bring the other rod 22 into use. The provision of a second rod such as 22 received in a part-cylindrical surface of the bore 18 also resists any tendency of the plug to rotate under load. Also, the resilient portions **24*a* act to seal the ends of the bore 18** to prevent the ingress of dirt and so assist in reducing wear.

Figure 4:
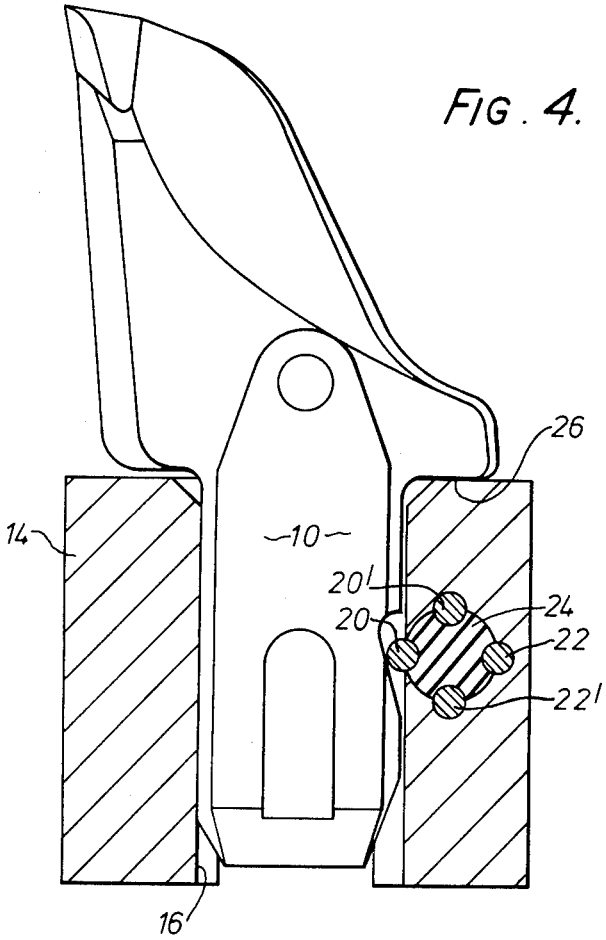
FIG. 4 is a view similar to that of FIG. 1 but showing another embodiment.

The embodiment of FIG. 4 is similar, except that the neoprene body 24 has bonded therein four metal rods 20, 20', 22 and 22' set 90° apart.

FIGS. 5 and 6 illustrate an embodiment in which the bore 18 is of substantially triangular section, and receives a neoprene body 50 which is also substantially triangular and has three metal rods 52, 54, 56 bonded into its apices. As seen in FIG. 6, here again the neoprene body extends over the ends of the rods to seal the bore.

Finally, FIG. 7 shows a neoprene body 70 of generally square section seated in a corresponding bore and having metal rods bonded in its corners.

It will be appreciated that metallic bodies in forms other than rods may be used, for example bodies with part-cylindrical surfaces extending from the resilient body but having flattened portions extending into the resilient body to assist in bonding.

I claim:

1. A boss having a socket therein for the reception of a shank of a tool and a locking arrangement for retaining the shank, the locking arrangement comprising a plug received in a bore extending through the boss transversely of the socket the arrangement being such that the bore intersects the socket along one side thereof, the plug comprising a body of a resilient material having bonded into the periphery thereof at spaced locations a plurality of metallic members which form semi-cylindrical protrusions from the surface of the resilient body, one of which semi-cylindrical protrusions protrudes from the bore into the socket for frictional engagement with the shank of the tool so as to retain the tool in position, the other(s) of the semi-cylindrical protrusions being disposed within semi-cylindrical extension means of the bore within said boss, and the arrangement of the metallic members being such that the plug may be axially removed from the bore, rotated and axially re-inserted to change the metallic member which protrudes into the socket.

2. A boss according to claim 1, in which the metallic members are equispaced around the periphery of the resilient body.

3. A boss according to claim 2, in which there are two metallic members.

4. A boss according to claim 3, in which the resilient body is of generally cylindrical form.

5. A boss according to claim 2, wherein there are three metallic members.

6. A boss according to claim 5, in which the resilient body is of generally triangular transverse section, the metallic members being bonded into the apices thereof.

7. A boss according to claim 2, wherein there are four metallic members.

8. A boss according to claim 7, in which the resilient body is of generally square transverse section, the metallic members being bonded into the corners thereof.

9. A boss according to claim 1, in which the metallic members have a length less than that of the resilient body, which body extends across the ends of the metallic members to provide sealing at the ends of the bore.

10. A boss according to claim 1, in which the metallic members are cylindrical rods.

* * * * *